United States Patent [19]

Huang

[11] Patent Number: 5,063,797

[45] Date of Patent: Nov. 12, 1991

[54] HAND-HELD TOOL FOR ROTATABLY DRIVING A BIT

[76] Inventor: Daniel C. L. Huang, No. 7, Alley 118, Lane 92, Jen-Hua Road, Ta-Li Hsiang, Taichung Hsien, Taiwan

[21] Appl. No.: 642,510

[22] Filed: Jan. 17, 1991

[51] Int. Cl.[5] ..... B25B 13/46

[52] U.S. Cl. ..... 81/60; 81/63.2

[58] Field of Search ..... 81/58.4, 60, 43.1, 63.2

[56] References Cited

U.S. PATENT DOCUMENTS 2,778,396 1/1957 Swain ..... 81/60

*Primary Examiner*—D. S. Meislin

*Attorney, Agent, or Firm*—Townsend and Townsend

[57] ABSTRACT

A ratchet screwdriver includes a first tubular member with an open end and a closed end. A bore extends from the open end towards the closed end. The inner side of the closed end has a recessed groove and the outer side of the same is connected to a handle. The wall of the first tubular member has a thorugh-hole therein into which two annular projections extend. A second tubular member has an open end and a closed end. A second bore for carrying a bit, extends from the open end towards the closed end of the same. A ratchet wheel with a shaft is co-axially mounted on the closed end of the second member, when fit in the bore of the first member the shaft is journalled in the recessed groove of the closed end of the first member. A locking mechanism baised by spring member, is mounted on the first member, and disposed in the through-hole of the first member, the lower end of which having an oblique side extending into a notch formed between two adjacent teeth of the ratchet wheel.

3 Claims, 7 Drawing Sheets

HAND-HELD TOOL FOR ROTATABLY DRIVING A BIT

BACKGROUND OF THE INVENTION

1. FIELD OF INVENTION

The invention relates to a hand-held tool which is used to rotatably drive a bit for fastening, drilling and similar operations, and more particularly to a hand-held tool which has a simple construction and which is more durable and convenient to use than prior art ones.

2. DISCUSSION OF THE RELATED ART

A hand-held tools which is used to rotatably drive a bit for the purpose of fastening, drilling and similar operations by means of a ratchet mechanism, such a ratchet screwdriver, is well known in the art. Referring to FIG. 1, the ratchet mechanism of a ratchet screwdriver includes a hollow body (1) having two notches (1*a*, 1*b*) for receiving two constraining plates (2) therein. The hollow body is sleeved on a shaft (3) having a ratchet wheel (3*a*) mounted thereon. The ratchet shifter (4) is used for depressing the constraining plates (2) to enable one of said constraining plates (2) to engage said ratchet wheel (3*a*) so as to cause the ratchet wheel to rotate clockwise or counterclockwise. It has been found that the ratchet mechanism of the ratchet screwdriver, functions well when used to rotatably drive a bit for the purpose of fastening or loosening a screw, but said ratchet mechanism also suffers quick wearing of the constraining plates (2) and the ratchet wheel (3*a*), while because the ratchet wheel (3*a*) always abuts upon one of the constraining plates and rotates with respect to it. This wear usually allows disengagement of the constraining plates and the ratchet wheel, and may render the entire tool useless.

SUMMARY OF THE INVENTION

It is therefore a main object of the present invention to provide a ratchet screwdriver which is durable and convenient to use.

Accordingly, the ratchet screwdriver of the present invention includes a first tubular member with an open end and a closed end. A bore extends from the open end to the closed end. The closed end is connected to a handle and has a central recessed groove on the inner side of the same. A through-hole passes through the wall of the first tubular member and opens on the bore of the same.

A second tubular member has an open end and a closed end. A second bore for carrying a bit therein, extends from the open end towards the closed. A ratchet wheel is co-axially mounted on the outer surface of the closed end. Notches are formed between adjacent teeth of the ratchet wheel. An annular groove is formed on the wall of the second tubular member. The ratchet wheel also includes an axial projection extending therefrom, which is received in the recessed groove of the closed end of the first tubular member when the second tubular member is rotatably fit into the bore of the first tubular member. A pin passes through the wall of the first tubular member and extends into the annular groove of the second tubular member preventing axial disengagement of the two.

A locking rod is disposed in the through-hole of the first tubular member and is depressed by a biasing means, mounted on the same member, so that the lower end of the locking rod, having an oblique side, extends into the notches of the ratchet wheel.

BRIEF DESCRIPTION OF THE DRAWING

Other features and advantages of the invention will become apparent in the following detailed description, including drawings, all of which show a non-limiting form of the invention, and of which.

DETAILED DESCRIPTION OF THE PREFERRED EMBODIMENT

Figure 1:
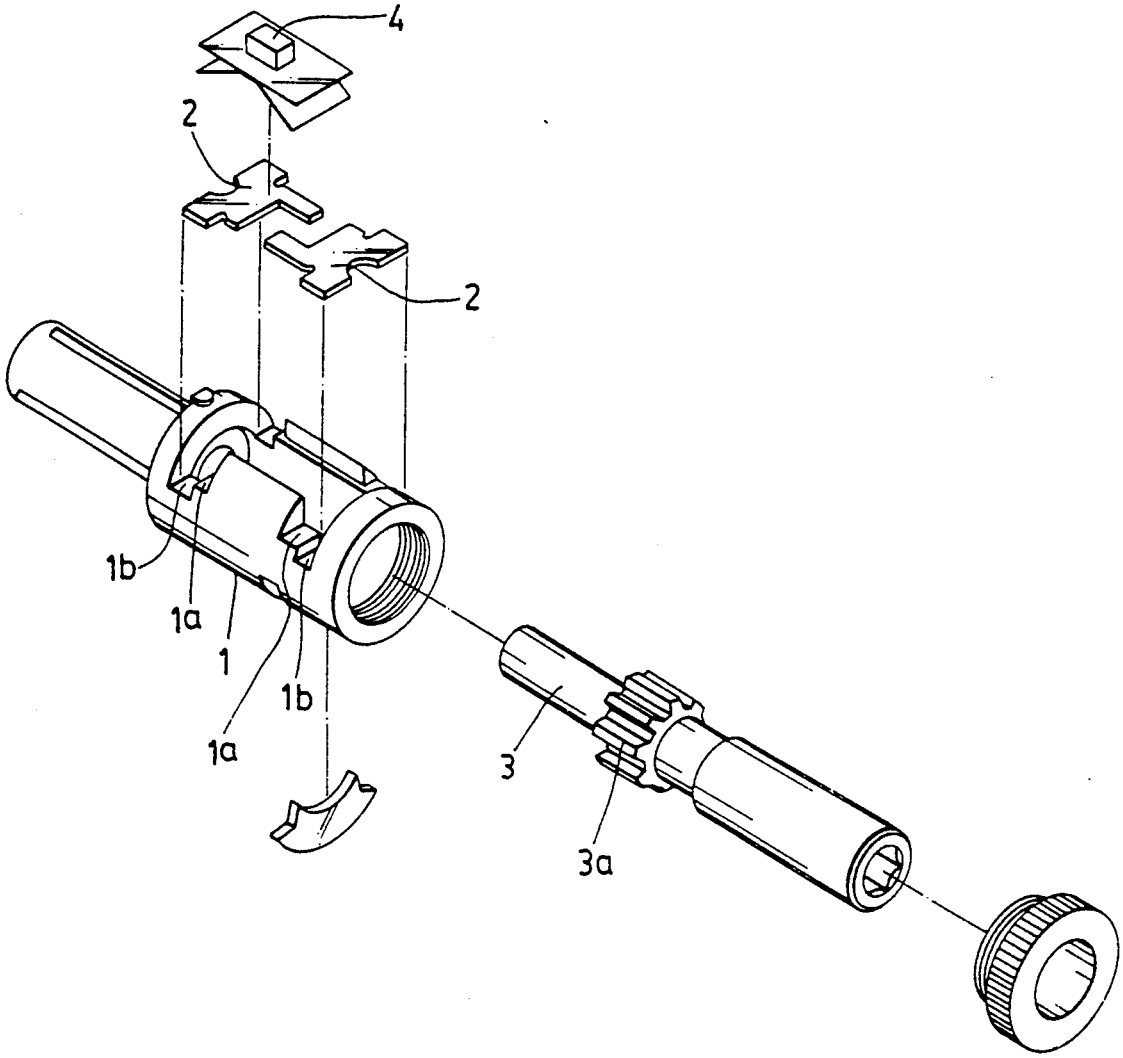
FIG.1 PRIOR ART
FIG. 1 shows an exploded view of a ratchet screwdriver of the prior art.
Figure 2:
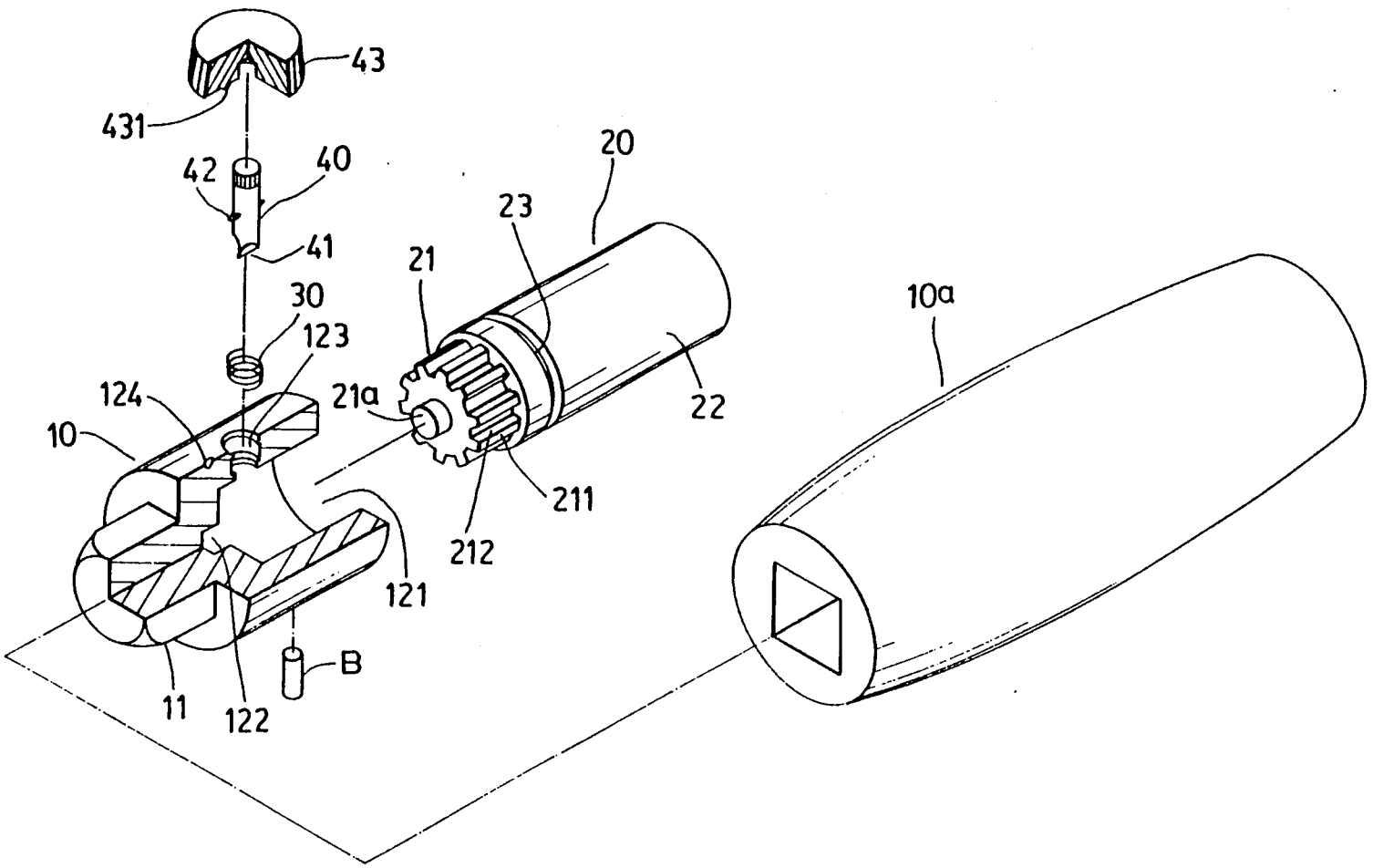
FIG. 2 shows an exploded view of a preferred embodiment of a ratchet screwdriver according to the present invention.

FIG. 2 shows an exploded view of a ratchet screwdriver of the present invention. As shown, the ratchet screwdriver includes a first tubular member (10) generally made of hard matter such as wood or metal, having an open end and a closed end. A bore (121) extends from the open end to the closed end. A recessed groove (122) is formed on the inner side of the closed end. The closed end has a connecting portion (11) on the outer side of the same and which is connected to a handle (10*a*). The wall of the first tubular member (10) has a through-hole (123) thereon and two annular projections extended into the same. A coil spring (30) is received in the through-hole (123) between the two annular projections so that said coil spring is contained in the through-hole (123) and does not extend into the bore (121) of the first tubular member.

Figure 3:
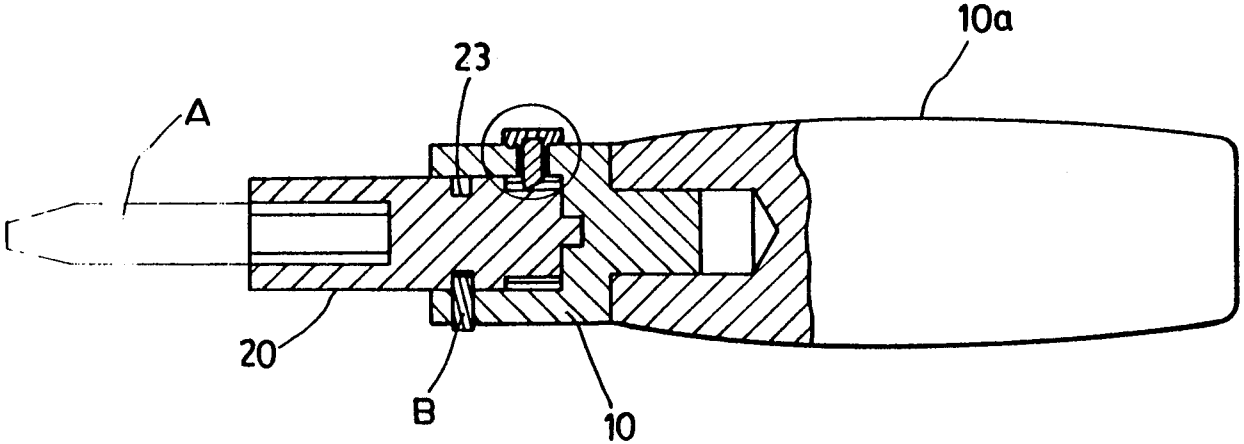
FIG. 3 shows a cross sectional view of the assembled ratchet screwdriver of FIG. 2.

A second tubular member (20) has an open end and a closed end. A second bore (22) for receiving a bit (A), see FIG. 3, extends from the open end to the closed end. The second tubular member (20) has an annular groove (23) on its wall adjacent to the closed end of the same. A ratchet wheel (21) is co-axially provided on the outer side of the closed end, and has a central axial protrusion (21*a*) extended therefrom. Notches (212) are formed between adjacent teeth (211) of the ratchet wheel (21). The protrusion (21*a*) is journalled in the recessed groove (122) of the closed end of the first tubular member when the second tubular member is rotatably inserted into the bore of the first tubular member. After insertion, the through-hole (123) on the first tubular member will be in communication with the ratchet wheel. Since the second tubular member (20) is rotatable in the bore (121) of the first tubular member, a notch of the ratchet wheel can be arranged to be aligned with the through-hole (123). A pin (B) passes through the wall of the first tubular member and is inserted into the annular groove (23) of the second tubular member so as to prevent axial disengagement of the two.

Figure 4:
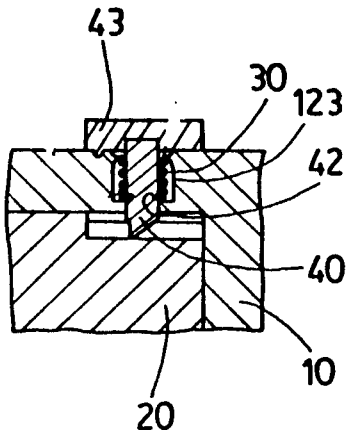
FIG. 4 is an enlarged, cross sectional view of the locking mechanism of the ratchet screwdriver of the present invention.
Figure 5A:
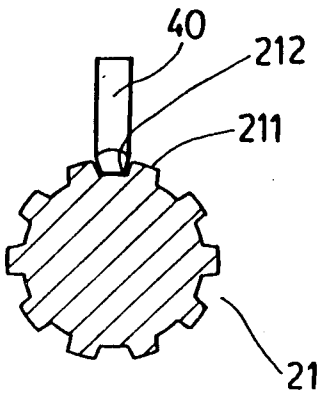
FIG. 5(A), shows the locking mechanism of FIG. 4 locking the ratchet wheel of the ratchet screwdriver of the present invention, in which configuration the ratchet screwdriver can be operated on a work piece.
Figure 5B:
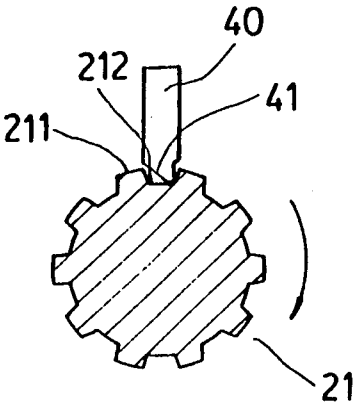
FIGS. 5(B) and 5(C) show the locking mechanism of FIG. 4 in unlocked configuration with respect to the ratchet wheel of the ratchet screwdriver of the present invention when the ratchet screwdriver can not be operated on a work piece.
Figure 5C:
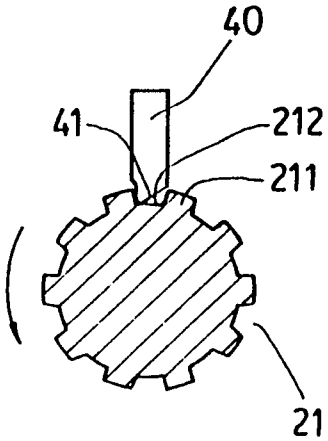
Figure 6:
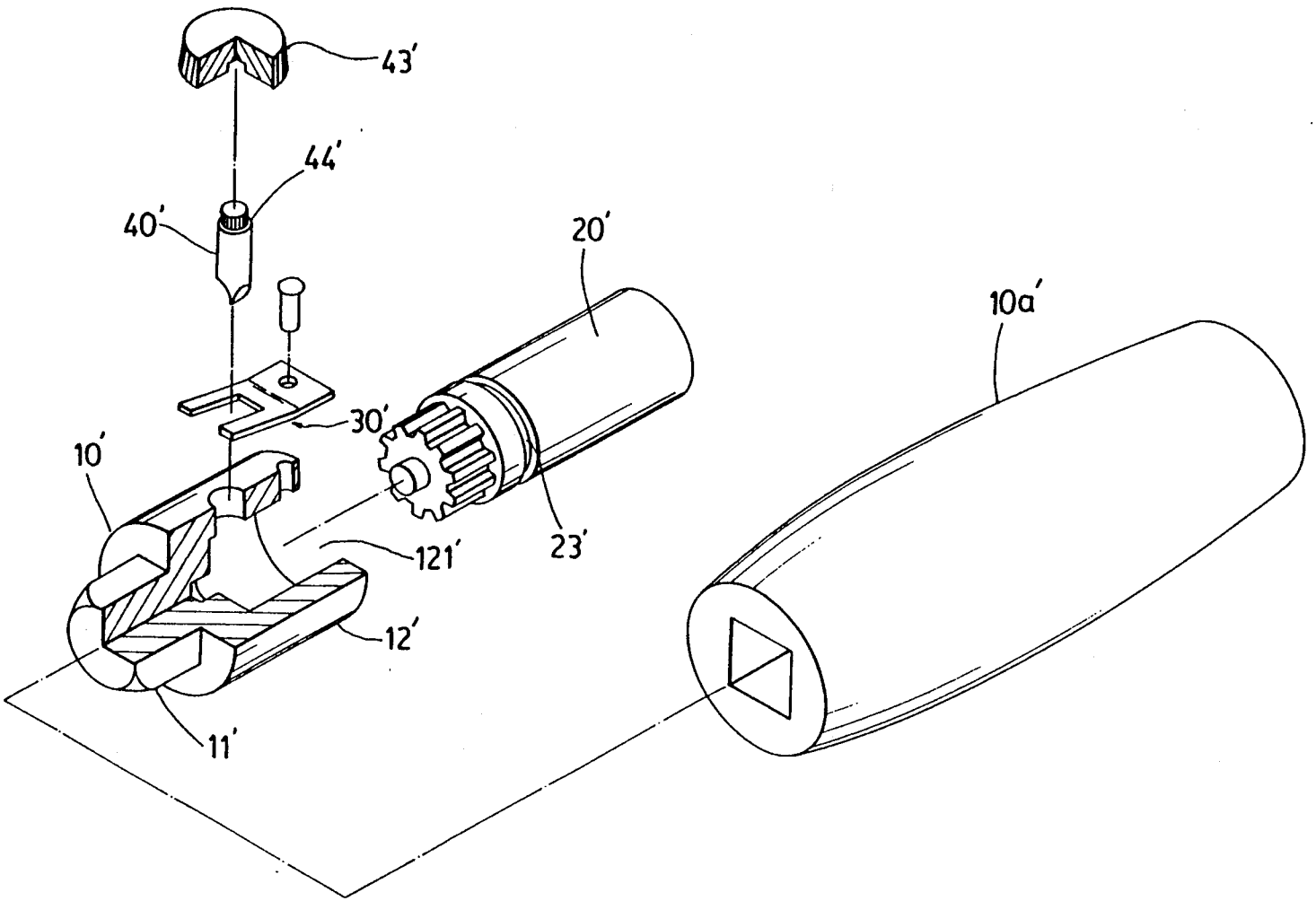
FIG. 6 shows an exploded view of another preferred embodiment of the ratchet wheel of the present invention.

The upper end of a locking rod (40) is fixed to a plate member (43). The lower end of the same has an oblique side and a projection (42) extends outwardly from the intermediate of the same. When disposed in the through-hole (123) of the first tubular member, the coil spring (30) depresses the projection (42) of the locking rod (40) downward so that the lower end of the same extends into a notch of the ratchet wheel (21), see in FIGS. 3 and 4. The plate member (43) has a projection (431) on the underside of the same which fits in the groove (124) on the first tubular member when the locking rod is inserted into the through-hole of the first tubular member. Once the ratchet screwdriver is thus assembled, a user can raise the plate member (43) to arrange the locking rod (40) in a first position such that the oblique side (41) of the lower end of the same faces one side of the notch (212), as shown in FIGS. 5(B) and 5(C). One tooth (211) of the ratchet wheel (21), when the handle (10*a*) is rotated in a first direction, will cam the oblique side (41) of the locking rod (40), forcing the rod to retreat into the through-hole and allow the ratchet wheel to rotate. Therefore the second tubular member (20) will not rotate with the first tubular member (10) when the handle (10*a*) is rotated in the first direction. When the handle (10*a*) is rotated in a second direction, opposite to the first direction, a tooth of the ratchet wheel will be stopped by the face of the locking rod opposite to the oblique side of the lower end of the locking rod, so that the second tubular member (20) can be rotated with the first tubular member (10). In the same manner, the locking rod (40) can be rotated 90 degrees from the first position, so that when the locking rod will be positioned in the notch (212) of the ratchet wheel as shown in FIG. 5(A). At this time, the oblique side of the lower end of the locking rod faces neither side of the notch (212), so the teeth adjacent to the locking rod will be stopped by the lower end of the same. In this condition, the second tubular member (20) can be rotated with the first tubular member (10).

Figure 7:
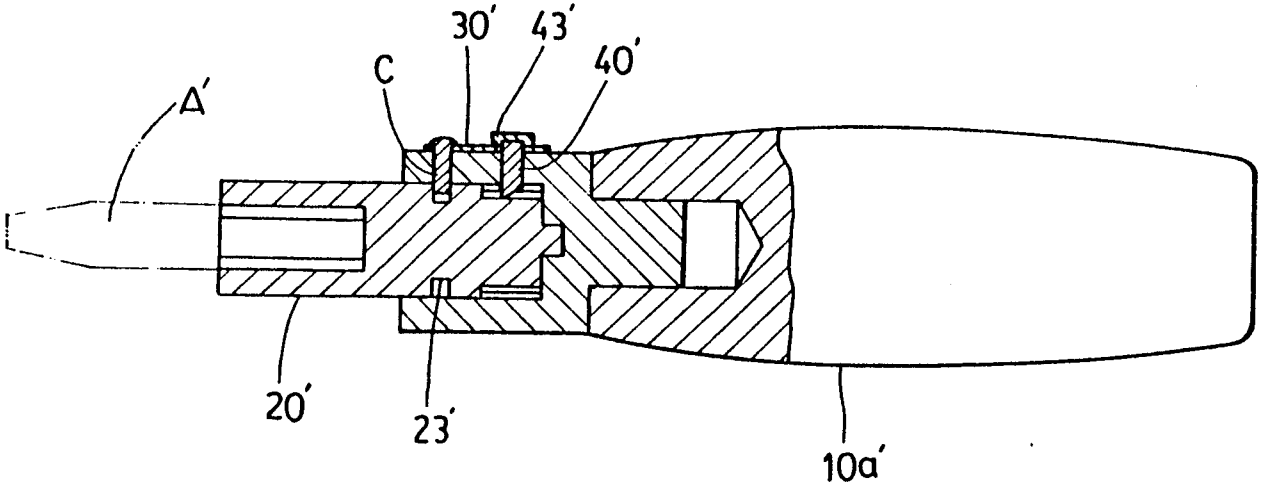
FIG. 7 shows a cross sectional view of the ratchet wheel of FIG. 6.
Figure 8B:
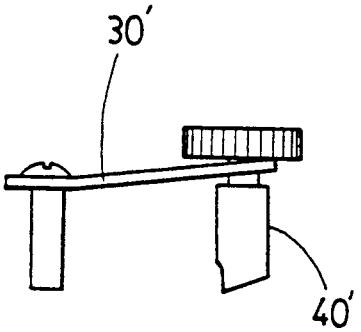
FIGS. 8(A) and 8(B) show the biasing means of the ratchet screwdriver of FIG. 6 biasing the locking mechanism of the same.
Figure 8A:
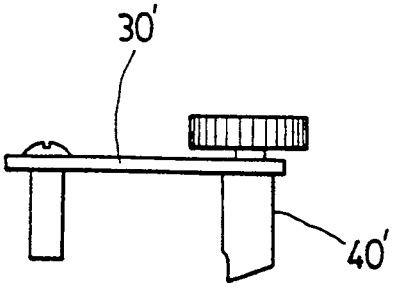

In one embodiment, the projection (44') on the locking rod (40') is formed near the upper end thereof. The locking rod (40') is biased downward by a reed spring member (30') mounted on the first tubular member so that the lower end of the same extends into a notch of the ratchet wheel, see in FIG. 7. As explained in above, the locking rod can be adjusted raising the reed spring member. The features and functions are similar to the first preferred embodiment, therefore need not be repeated.

With the invention thus explained, it is obvious to those skilled in the art that various modifications and variations can be made without departing from the scope and spirit of the present invention. It is therefore intended the invention be limited only as indicated in the appended claims.

I claim:

1. A ratchet screwdriver comprising:

a first tubular member having an open end and a closed end, a bore extending from said open end towards said closed end, a central recessed groove being formed on the inner side of said closed end, said closed end being connected to a handle, a radial hole being formed in the wall of said first tubular member and being in communication with said bore of said first tubular member;

a second tubular member having an open end and a closed end, a second bore extending from said open end to said closed end of the same, said second bore receiving a bit for driving a workpiece, a ratchet wheel being co-axially fixed to a face of said closed end, said ratchet wheel having a central protrusion extended therefrom, notches being formed between adjacent teeth of said ratchet wheel, each of said notches having a substantially U-shaped with two sides, an annular groove being formed on the outer surface of the wall of said second tubular member, said second tubular member being rotatably inserted in said first tubular member with said central protrusion being journalled in said recessed groove of said closed end of said first tubular member so that said second tubular member can be co-axially rotated with respect to said first tubular member, one of said notches of said ratchet wheel being aligned with said radial hole of said first tubular member when said second tubular member is rotated through an angle, a pin passing through the wall of said first tubular member and extending into said annular groove of said second tubular member so as to prevent said second tubular member from disengaging axially from said first tubular member;

a locking rod having an upper end and a lower end, said upper end having a radial protrusion extending from the same, said lower end having an oblique side, said locking rod being rotatably and slidably retained in said radial hole of said first tubular member; and a means provided on said second tubular member adjacent to said radial hole for biasing said radial protrusion of said locking rod to move towards said ratchet wheel, allowing said lower end of said locking rod to be inserted into one of said notches of said ratchet wheel, such that when said locking rod is rotated to a first position wherein said oblique side of the same faces one side of said notch, said teeth of said ratchet wheel cam said oblique side of said locking rod, pushing said rod outward so it retreats into said through-hole when said first tubular member is rotated in a first direction, so that said second tubular member will not rotate with said first tubular member, while said first tubular member is rotated in a second direction opposite to said first direction, a tooth adjacent to said notch will be stopped by the face opposite said oblique side of said lower end of said locking rod so that said second tubular member can be rotated with said first tubular member, and when said locking rod is rotated 90 degrees from said first position so as not to have said oblique side of said lower end facing one side of said notch, said teeth adjacent to said locking rod will be stopped by said lower end of said locking rod, so that said second tubular member can be rotated with said first tubular member.

2. A ratchet screwdriver as claimed in claim 1, wherein said biasing means is a coil spring.

3. A ratchet screwdriver as claimed in claim 1, wherein said biasing means is a spring reed.

* * * * *